US005265430A

United States Patent [19]

Chen et al.

[11] Patent Number: 5,265,430

[45] Date of Patent: Nov. 30, 1993

[54] ACTIVELY COOLED BAFFLE FOR SUPERCONDUCTING MAGNET PENETRATION WELL

[75] Inventors: William E. Chen; Daniel C. Woods, both of Florence, S.C.

[73] Assignee: General Electric Company, Milwaukee, Wis.

[21] Appl. No.: 892,839

[22] Filed: Jun. 3, 1992

[51] Int. Cl.[5] ..... F17C 7/04

[52] U.S. Cl. ..... 62/48.1; 62/511

[58] Field of Search ..... 62/48.1, 51.1

[56] References Cited

U.S. PATENT DOCUMENTS

| | | | |
|---|---|---|---|
| 3,598,178 | 8/1971 | Staub | 62/51.1 |
| 3,654,377 | 4/1972 | Fleming et al. | 62/51.1 |
| 3,705,498 | 12/1972 | Dehaan | 62/48.1 |
| 3,965,689 | 6/1976 | Brown et al. | 62/48.1 |
| 4,350,017 | 9/1982 | Kneip et al. | 62/48.1 |

*Primary Examiner*—Ronald C. Capossela

*Attorney, Agent, or Firm*—James O. Skarsten

[57] ABSTRACT

Apparatus for reducing heat leakage into the interior of a liquid cryogen-holding vessel from the sealed well through which the vessel is accessed. An actively cooled heat sink in the well transfers heat to low temperature cryogen vapor venting from this vessel to the external environment.

7 Claims, 2 Drawing Sheets

FIG. 4
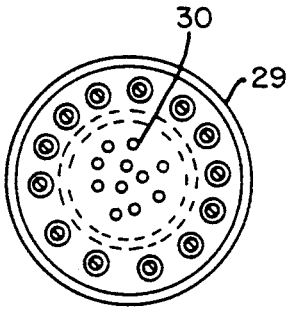
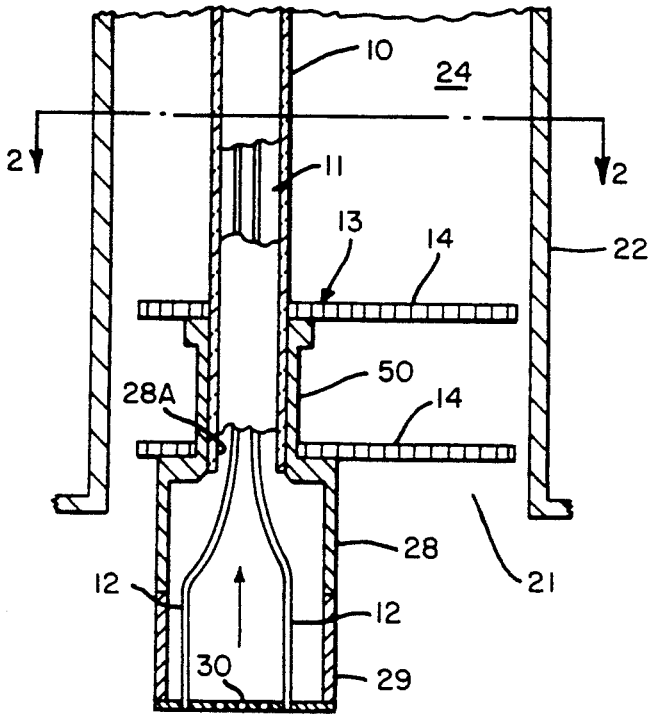
FIG. 2
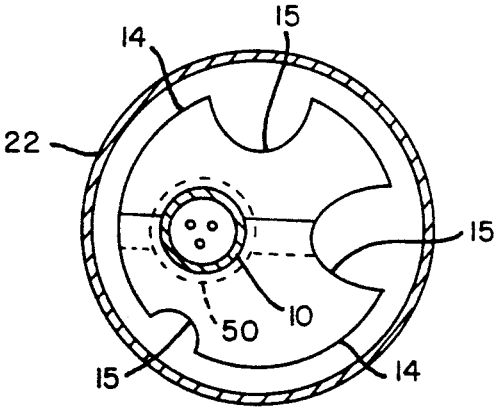
FIG. 3

ACTIVELY COOLED BAFFLE FOR SUPERCONDUCTING MAGNET PENETRATION WELL

BACKGROUND OF THE INVENTION

The present invention relates in general to cryostats and in particular to cryostat apparatus for reducing heat leakage into the interior of a vessel that must be kept at a low temperature, e.g. a vessel containing a superconducting magnet immersed in a liquid cryogen, such as helium which has a boiling point of approximately 4 K. In order to maintain the interior of the vessel at its low temperature and to contain the operating costs of the cryostat by reducing the loss of cryogen due to boil-off, currently available cryostats take elaborate measures to minimize the amount of heat that leaks into the cryostat vessel. This is particularly important with respect to the well structure through which the vessel is accessed from its external environment.

For example, in order to reduce the heat leaked into the vessel by electrical wires that pass through the well structure, it is known to intercept this heat leak by using the cryogen vapor which is formed during the boil-off of the liquid and which is otherwise vented to the external environment. Heat may also be transferred into the vessel by the gaseous conduction of the cryogen vapor in the well, by radiation into the well, and by solid conduction of the well material. It is known to use reflective baffles in order to reduce the amount of heat radiated into the well. Notwithstanding these measures, it is estimated that in currently available cryostats as much as 60% of the total heat leakage into the vessel occurs through the well structure.

Accordingly, it is a principal object of the present invention to substantially reduce the amount of heat that leaks into a cryostat vessel through its associated well structure during the operation of the cryostat.

It is a further object of this invention to reduce the operating costs of a cryostat by reducing the liquid cryogen boil-off rate.

SUMMARY OF THE INVENTION

In accordance with the present invention, new and improved apparatus is provided for reducing heat leakage into the interior of a liquid cryogen-holding vessel through the sealed well structure of the vessel and its access opening. An interior tube extends into the well from the surrounding external environment and carries a heat sink at one of its ends proximate the access opening of the vessel. The heat sink includes rigid baffle plates positioned to cover a substantial portion of the cross section of the well, and a hollow end piece which extends into the vessel and allows vaporized cryogen to vent into the interior tube and thence to the external environment.

According to one aspect of the invention, heat in the well is absorbed by the baffle plates. The baffle plates are actively cooled by the low temperature cryogen vapor that passes through the end piece. Hence, the heat sink and the well are kept at a low temperature and heat is prevented from leaking into the vessel in any substantial amount.

The subject matter which is regarded as the invention is particularly pointed out and distinctly claimed in the concluding portion of the specification. The invention however, both as to organization and method of practice, together with further objects and advantages thereof, may best be understood by reference to the following description taken in conjunction with the accompanying drawings.

BRIEF DESCRIPTION OF THE DRAWINGS

FIG. 2 illustrates in greater detail a portion of the structure shown in FIG. 1.

FIG. 3 is a cross sectional view taken at line 2—2 of FIG. 2.

FIG. 4 is a bottom view of the perforated coupling shown in FIG. 2.

DETAILED DESCRIPTION OF THE INVENTION

Figure 1:
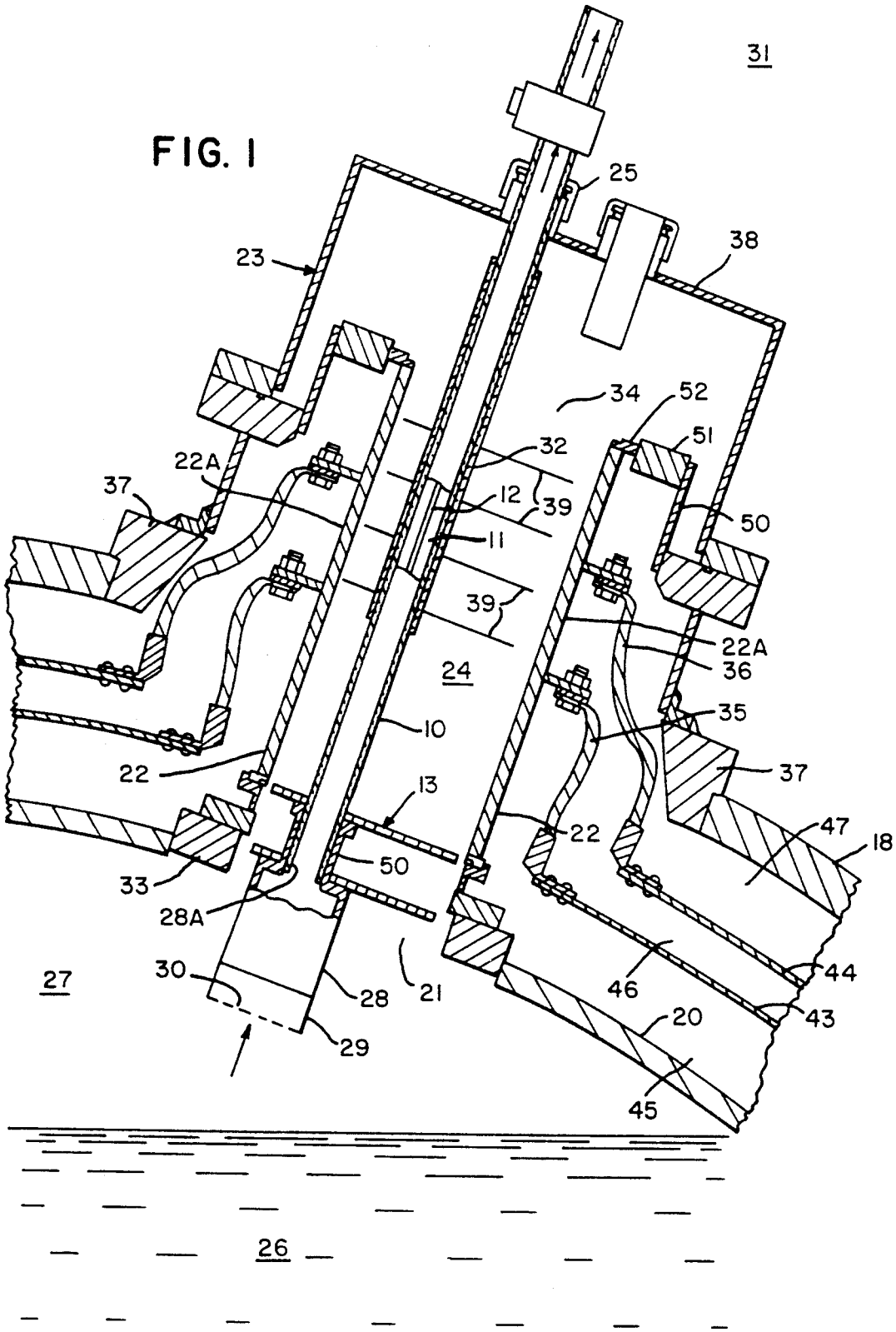
FIG. 1 is a partial cross sectional view of a cryostat structure for accessing a cryogen vessel.

With reference now to the drawings, FIG. 1 shows a portion of a cryostat in which a cryogen vessel 20 holds a superconductive magnet (not shown) which may be used for purposes of magnetic resonance imaging or the like. The magnet is immersed in a cryogen liquid 26, preferably liquid helium, which may be at a temperature on the order of 4 K. The cryostat and the related structure may be similar to that disclosed in U.S. Pat. No. 4,771,256, assigned to the assignee of the present invention. As shown in FIG. 1, vessel 20 is surrounded by heat shields 43 and 44, and by an outer wall 18, which cooperate with other structural elements to form hermetically sealed spaces 45, 46, 47. A vacuum is maintained in these spaces in order to provide a thermal barrier against heat leakage into vessel 20 from the external environment 31.

Vessel 20 includes an access opening 21 which permits access to the vessel's interior. A cylindrical penetration tube 22 is mounted on an annular platform 33 which surrounds the perimeter of access opening 21. Penetration tube 22 extends outward from the access opening and terminates in an open end 34. Although shown as having a straight cylindrical wall 22A, preferably consisting of stainless steel, the wall of penetration tube 22 may instead be bellows-shaped which effectively lengthens the thermal path presented by the tube. Flexible copper braids 35 and 36 surround penetration tube 22 at intervals. The braids are fastened between wall 22A and heat shields 43 and 44, respectively to minimize the amount of heat conducted into vessel 20 by wall 22A.

A cylindrical turret, generally indicated at 23, is mounted on an annular platform 37 which forms the perimeter of an opening in outer wall 18. Turret 23 coaxially surrounds penetration tube 22 and extends outward beyond the open end 34 of this tube. A cover plate 38 closes off turret 23 and includes a hermetically sealed port 25. A set of sealing elements 50, 51 and 52 connect turret 23 to penetration tube 22 and effectively close off vacuum space 47. Structures 22 and 23 jointly form a well 24 which is hermetically sealed off from vacuum spaces 45, 46 and 47, as well as from the external environment.

A interior tube 10 enters well 24 from external environment 31 through port 25 and extends linearly into the well. Tube 10 terminates in a tube end 28A located proximate access opening 21. Tube 10 consists of thermal insulating material, e.g. a fiber glass material known commercially as G-10 material, which inhibits the conductive transfer of heat into well 24. A heat sink 13 includes a thermally conductive sleeve 50 which is fastened to tube end 28A. Sleeve 50 terminates in a hollow end piece 28 of expanded diameter which extends beyond tube end 28A into the interior of vessel 20.

As best shown in FIGS. 1 and 2, a perforated coupling 29 mates with end piece 28 and extends from the latter into a region 27 in vessel 20. Vaporized cryogen, resulting from the boil-off of the liquid cryogen 26, collects in this region. As best seen in FIG. 4, coupling 29 includes perforations 30 which allow the cryogen vapor to enter the coupling for passage into hollow end piece 28 and thence into interior tube 10. Coupling 29 further contains provisions for connecting a set of wires 12 to electrical equipment (not shown) within vessel 20. For the sake of clarity of illustration, only two wires are shown in FIG. 2.

Tube 10 provides a passageway 11 for venting the cryogen vapor from region 27 to the external environment. Passageway 11 provides space for wires 12 which may consist of brass or similar electrically conductive material of relatively low thermal conductivity as compared to copper. Wires 12 establish connections between electrical equipment located in the environment external to turret 23 and in the interior of vessel 20, respectively.

As will be appreciated by those skilled in the art, external environment 31 will normally be at a high temperature relative to the interior of vessel 20. As stated above, it is important that the amount of heat from this source that enters well 24 be kept to a minimum.

Turret 23 and its cover plate 38 constitute a major heat source for well 24. These parts, due to exposure to the surrounding warm environment, tend to radiate substantial amounts of heat into well 24. As already explained, some of this heat is reflected back by a plurality of thin, flexible baffles 39 which consist of a highly reflective material such as metallized Mylar. These reflector baffles are attached at spaced intervals to an external sleeve 32 of tube 10. The material of sleeve 32 is chosen for its low thermal conductivity, i.e. a material which reduces the heat into the well through solid conduction. Thus, the effect of reflector baffles 39 is to reduce heat radiation into well 24.

Heat sink 13, best shown in FIG. 2, is intended to capture the major portion of the heat that would otherwise leak through well 24 into vessel 20. It includes a pair of thermally conductive, rigid baffle plates 14 consisting of copper or aluminum, or of a similar thermally efficient conductor. Plates 14 are substantially identical, being mutually spaced along the axis of interior tube 10 and parallel to each other. Sleeve 50 and end piece 28 likewise consist of an efficient thermal conductor such as copper or aluminum. In contrast to baffles 39, plates 14 have relatively large mass so as to serve their intended heat sink function.

FIG. 3 shows plates 14 in top view. Each plate has cutouts 15 which allow other equipment, e.g. tubing or wiring, to extend beyond the plates into vessel 20. Each plate has its own angular orientation around the axis of interior tube 10. The plates are positioned to overlap in part and they jointly cover substantially the complete cross sectional area of well 24. The axial spacing of plates 14 from each other allows a continuous escape path for gas from vessel 20 to the external environment. A suitable escape port (not shown) is provided in turret 23 as part of such escape path. The path is required in the event of an unforeseen magnet quench which would cause relatively large amounts of cryogen vapor to be rapidly formed within vessel 20. The resultant pressure build-up must be relieved instantly to prevent damage to the equipment.

In operation, when low temperature cryogen vapor enters perforated coupling 29, it passes through the coupling into hollow end piece 28 and subsequently into passageway 11 of interior tube 10. As the low-temperature vapor passes through the end piece, heat absorbed by plates 14 of the heat sink is conductively/convectively transferred to the venting vapor and thus to the external environment. As a consequence, the amount of heat in the well is reduced, thereby diminishing the amount that can leak into vessel 20. Thus, as distinguished from the action of baffles 39 which reduce the amount of heat radiated into well 24, heat sink 13 absorbs the heat that has leaked into the well and conductively/convectively transfers it to the cryogen vapor venting through tube 10.

As observed in prototype apparatus which incorporated the heat sink herein described, the heat leakage rate from the well into the vessel was reduced by about 12 milliwatts. As a consequence, the liquid helium boil-off rate in the prototype was reduced by about 15% over similar cryostats that operated without such a heat sink.

The present invention has been described in the context of a cryostat wherein a superconducting magnet that may be used for magnetic resonance imaging is immersed in liquid helium. It will be understood that the specific embodiment of the invention shown and described herein is exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be determined solely by the appended claims.

What is claimed is:

1. Cryostat apparatus comprising:

a vessel for holding liquid cryogen, said vessel including an access opening;

a sealed structure extending outward from said vessel, said structure enclosing a well in communication with the interior of said vessel through said access opening;

an interior tube extending into said well from the environment external to said sealed structure and providing a passageway for vapor vented from said vessel to said external environment, said interior tube having one end thereof positioned proximate said access opening;

a heat sink affixed at said one tube end, said heat sink consisting of thermally conductive material and including at least one rigid plate oriented to cover a substantial portion of the cross sectional area of said well; and a perforated coupling extending from said heat sink into said vessel to a region of low-temperature vaporized cryogen, said coupling allowing vapor to pass into said passageway by way of said heat sink;

whereby heat absorption by said heat sink and heat transfer to said external environment by means of the cryogen vapor venting through said interior tube prevent heat from leaking into said vessel.

2. Apparatus as recited in claim 1, wherein said passageway includes a set of wires exposed to cryogen vapor venting through said passageway, said wires being capable of providing electrical connections by way of said coupling between said vessel and equipment external to said structure.

3. Apparatus as recited in claim 1 wherein said interior tube consists primarily of thermal insulating material; and said heat sink further including a sleeve affixed at said one tube end, said sleeve terminating in a hollow end piece configured to mate with said perforated coupling, said end piece being effective to establish a thermal link with the cryogen vapor venting therethrough.

4. Apparatus as recited in claim 1 wherein said sealed structure comprises a substantially cylindrical penetration tube defining a portion of said well near said access opening;

said structure further including a turret surrounding a segment of said penetration tube and defining the remaining portion of said well remote from said access opening, said turret including a hermetically sealed port positioned opposite said access opening; and said interior tube extending from said one tube end throughout said well and through said port.

5. Apparatus as recited in claim 1 wherein said heat sink includes a plurality of substantially identical, mutually spaced plates positioned parallel to each other, each of said plates having an angular orientation around the axis of said interior tube such that the plates jointly cover substantially the full cross sectional area of said well.

6. Apparatus as recited in claim 1, wherein said cryogen consists of liquid helium.

7. Cryostat apparatus comprising:

a vessel for holding liquid helium, said vessel including an access opening;

a sealed well in communication with the interior of said vessel through said access opening;

said well being defined by a substantially cylindrical penetration tube extending in an outward direction from said access opening, and by a turret coaxially enclosing a segment of said penetration tube remote from said access opening;

a hermetically sealed port in said turret positioned opposite said access opening;

an interior tube extending throughout the length of said well and through said port to the environment external to said well, said interior tube consisting primarily of thermal insulating material and providing a passageway for venting low-temperature helium vapor from said vessel to said external environment;

a set of wires in said passageway for connection to electrical equipment external to said turret;

a thermally conductive heat sink including a plurality of substantially identical, parallel, rigid plates mutually spaced along the axis of said interior tube, each of said plates having an angular orientation around the interior tube axis such that the plates jointly cover substantially the full cross sectional area of said well;

said heat sink further including a sleeve affixed at one end of said interior tube proximate said access opening, said sleeve terminating in a hollow end piece extending into said vessel; and a perforated coupling configured to mate with said end piece and capable of establishing electrical connections between said wires and said vessel, said coupling extending from said end piece to a region of low-temperature vaporized helium to allow said helium vapor to vent into said passageway by way of said end piece;

whereby a thermal link is established between said heat sink and low-temperature helium vapor passing through said end piece to effectively reduce the amount of heat able to leak into said vessel through said well.

* * * * *